US007050841B1

(12) United States Patent
Onda

(10) Patent No.: US 7,050,841 B1
(45) Date of Patent: May 23, 2006

(54) PROTECTIVE ENCLOSURE FOR A HAND-HELD ELECTRONIC DEVICE THAT BOTH STORES AND PLAYS DIGITAL AUDIO RECORDINGS

(76) Inventor: Hideki Francis Onda, 1-3-2 Minami-Azabu, Tokyo (JP) 106-0047

( * ) Notice: Subject to any disclaimer, the term of this patent is extended or adjusted under 35 U.S.C. 154(b) by 107 days.

(21) Appl. No.: 10/931,069

(22) Filed: Aug. 30, 2004

(51) Int. Cl.
*H04M 1/00* (2006.01)

(52) U.S. Cl. ..... 455/575.8; 455/550.1

(58) Field of Classification Search ..... 455/90.3, 455/550.1, 575.1, 575.8
See application file for complete search history.

(56) References Cited

U.S. PATENT DOCUMENTS

| | | | |
|---|---|---|---|
| 4,836,256 | A | 6/1989 | Meliconi |
| 6,616,111 | B1 | 9/2003 | White |
| 6,701,159 | B1 | 3/2004 | Powell |
| 6,731,913 | B1 | 5/2004 | Humphreys |
| 6,785,566 | B1 * | 8/2004 | Irizarry ..... 455/575.8 |
| 2004/0204204 | A1 * | 10/2004 | Brilliant et al. ..... 455/575.1 |

FOREIGN PATENT DOCUMENTS

WO WO 03/041288 A2 5/2003

* cited by examiner

*Primary Examiner*—Nick Corsaro
*Assistant Examiner*—Gary Au

(57) ABSTRACT

A form-fitted protective enclosure with shock-resistant features to protect an inserted hand-held electronic device that both stores and plays digital audio recordings. The enclosure protects the inserted hand-held electronic device from impacts, wear and tear, inadvertent dropping due to protruding ribs that afford a sure grip along with other protection features, and rear surface slot openings for interweaving a belt or strap. The protective enclosure provides openings for easy access to the electronic device's visual display screen and to the electronic device's controls. The protective enclosure's rectangular visual display screen opening has a protruding frame with the same depth as the protruding ribs for extra protection of the electronic device's visual display when the enclosed electronic device is laid down on a flat surface.

6 Claims, 2 Drawing Sheets

PROTECTIVE ENCLOSURE FOR A HAND-HELD ELECTRONIC DEVICE THAT BOTH STORES AND PLAYS DIGITAL AUDIO RECORDINGS

CROSS-REFERENCE TO RELATED APPLICATIONS

NONE

FEDERALLY SPONSORED RESEARCH

NONE

SEQUENCE LISTING OR PROGRAM

NONE

BACKGROUND OF THE INVENTION

1. Field of the Invention

The present invention is a specially designed form-fitted protective enclosure with shock-resistant features to protect a hand-held electronic device that both stores and plays digital audio recordings from impacts and wear and tear while affording a sure grip and easy access to a display screen and playback controls of the device. The invention also features slotted openings for inserting a belt or other strap for extra security while transporting and operating the device.

2. Prior Art

U.S. Pat. No. 6,731,913 B2, issued on May 4, 2004 to Morris Humphreys and Peter Lopez, for an Elastomeric Enclosure, discloses an enclosure for a portable electronic device such as a mobile telephone. The enclosure includes a cover made of an elastomer so that it can be stretched over the chassis containing the device's internal components.

U.S. Pat. No. 6,701,159 B1, issued on Mar. 2, 2004 to Andrew P. Powell, for a Jacket for Cellular Phone, discloses a protective enclosure for a rectilinearly-shaped cellular telephone having an external antenna. The protective enclosure comprises an enclosure web portion covering the front, sides, top and bottom portions of the cellular telephone. An opening is arranged through at least one of the enclosure web portions to permit exposure of certain components of the cellular telephone, and a bulbous corner pad is arranged on the lower corner portions of the cellular telephone to protect it if it is dropped and aid in holding the phone.

U.S. Pat. No. 6,616,111 B1, issued on Sep. 9, 2003 to Gabriel A. White, for a Hand Held Electronic Device of Game Impact Protector, discloses an elastomeric impact protector that includes one trough-like piece conformed to receive one edge of an electronic device attached along one edge of a generally X-shaped elastomeric web. A set of corner receiving pockets at the free ends of the web are then engageable to the opposite edge of the device by stretching the web. The piece and the pockets are each formed to a thickness to extend beyond the plane of the corresponding surface of the device captured therein.

U.S. Pat. No. 4,836,256, issued on Jun. 6, 1989 to Loris Meliconi, for a Shockproof Protective Sheath for Remote Controls, In Particular Those of Television Receivers, discloses a shockproof protective sheath for television remote controls, which comprises a hollow container and holder element, embodied in shockproof material, that substantially matches and hugs the external profile of the appliance it encompasses and is provided with at least two openings, one of which affording access to the push buttons, the other allowing passage of the control pulses.

A PCT application, WO 03/041288 A2, filed internationally May 15, 2003 for a Protective Sleeve for Small Portable Electronic Devices, in particular mobile or wireless telephones, is disclosed, comprising at least one strap-like elastic loop, which at least partly surrounds the external circumference of the device when applied to the device. According to the invention, only one loop is provided which is a highly elastic tubular ring, the material, diameter, height and wall thickness of which are arranged such that, when tightly applied to the device, the external circumferential cover of the device is covered and the end edges of the loop are drawn elastically inwards on both front faces of the device and lie thereon in the form of narrow strips, forming a frame.

3. Objects and Advantages

It is an object of the invention to provide a protective cover to protect the hand-held electronic device from scratches, wear and tear. Another object of the protective enclosure is to protect the inserted hand-held electronic device from the shock of dropping or other impacts. This invention has numerous advantages over the prior art due in part to the configuration of the protruding ribs on the long sides of the device when the protective enclosure is fitted over the hand-held electronic device to absorb shocks on impact with other objects or surfaces. Another advantage over the prior art due to said protruding ribs is to provide the owner with a sure grip on the protective enclosure with the inserted hand-held electronic device. Another advantage over the prior art due to said protruding ribs being wrapped to the front and rear of the protective enclosure is to protect the exposed visual display and controls on the inserted hand-held electronic device when the protective enclosure is placed on a flat surface. Another advantage over the prior art is due to the protruding rectangular frame around the visual display to protect said display when the protective enclosure is placed on a flat surface. Another advantage over the prior art is due to the parallel slotted openings in the rear surface of the enclosure to afford securing the device with an interwoven belt or strap to prevent dropping.

BRIEF SUMMARY OF THE INVENTION

The present invention is a protective enclosure for a hand-held electronic device that both stores and plays digital audio recordings. In today's technology, digitally recorded music or other content can be stored in digital storage media, comprising for example: semiconductor chips, computer-readable diskettes, CD-ROMs, hard drives, and others.

Readily available hand-held electronic devices in the marketplace are capable of storing and playing back digital audio recordings. These digital recordings are often downloaded or uploaded to the hand-held electronic device using external cables or other fittings allowing the passage of digital recordings to and from the hand-held electronic device. Some of the popular devices for this purpose use computer hard-drives in a pleasing, small rectangular package, with the device controls and a visual display built into the device. Such devices would decidedly benefit from a protective enclosure such as the subject invention, as it protects the hand-held electronic device from scratches, wear and tear, and minor shocks due to impacts with solid objects or other surfaces.

The invention's protective enclosure is made of a material that is relatively elastic so as to form a tight, secure fit around the storage/playback device, while at the same time having cut-outs that afford access by the owner to the control and display features of the storage/playback device. The invention also features ribs arranged on both of the long sides of the protective enclosure that absorb and diminish minor shocks due to bumps and drops of the device. The ribs also provide a sure grip for the hand-held device owner when carrying the device inserted into the protective enclosure. The ribs also provide protection for the hand-held electronic device's display and controls when placed face down on the front surface of the protective enclosure as they are raised above the flat portions of the protective enclosure. The rectangular visual display opening also contains a protruding frame of the same depth as the protruding ribs for additional protection and stability when the protective enclosure with inserted hand-held electronic device is placed front face down on a flat surface.

In providing the device owner access to the controls and display of the device, the invention is completely open at one end so as to allow the device to be inserted into the protective enclosure, and the opposite end of the invention is closed to prevent the device from slipping out of the protective enclosure, yet the bottom closure has an opening to allow access for external connective wires or other device controls.

BRIEF DESCRIPTION OF THE DRAWINGS

1. Figures

Numeral 30, enclosure base to prevent the inserted device from passing through the enclosure while being carried or in use Numeral 35, enclosure opening to allow for inserting the device to be protected into the enclosure

DETAILED DESCRIPTION PREFERRED EMBODIMENT

The present invention is a protective enclosure for a hand-held electronic device that both stores and plays digital audio recordings.

Figure 1:
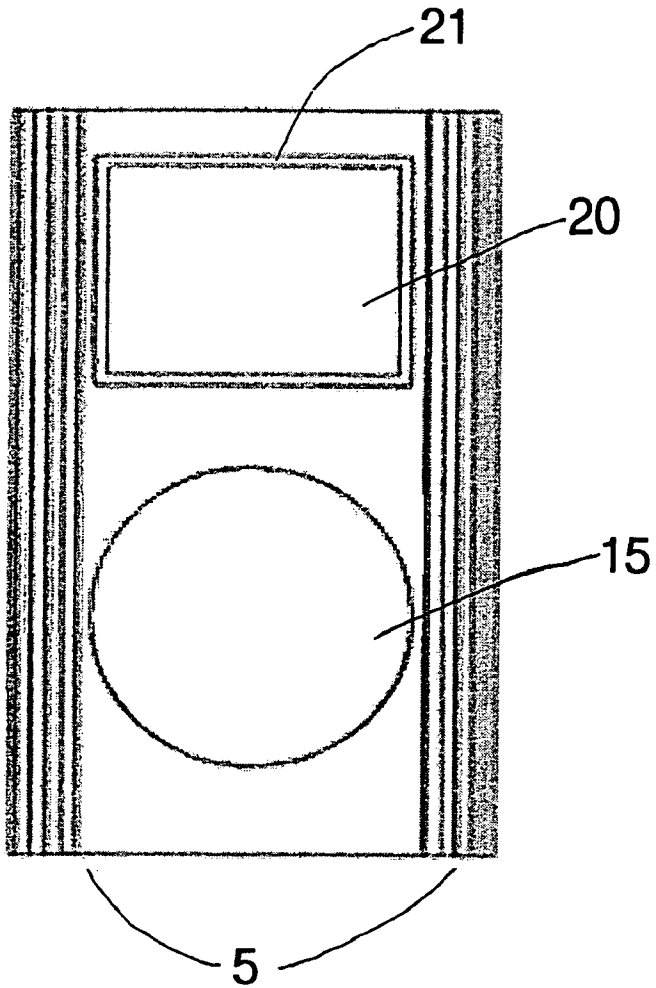
FIG. 1 is a perspective view of the protective enclosure as viewed from the front, showing the visual display opening, the controls opening and the ribs

FIG. 1 is a perspective view of the protective enclosure as viewed from the front, showing the rectangular visual display opening 20, wherein the device's visual display is not shown, the rectangular raised frame around the visual display opening 21, the circular controls opening 15, wherein the actual device controls are also not shown, and the protective enclosure ribs 5, are shown in their full length. The enclosure ribs 5 wrap around the long sides of the protective enclosure and into the front of the protective enclosure, thus affording protection, in the event the enclosed device is laid front face down by the user. The enclosure ribs 5 also afford protection for the enclosed device on the sides in the event of impacts with objects, as well as affording the user a sure and secure grip on the enclosed device.

Figure 2:
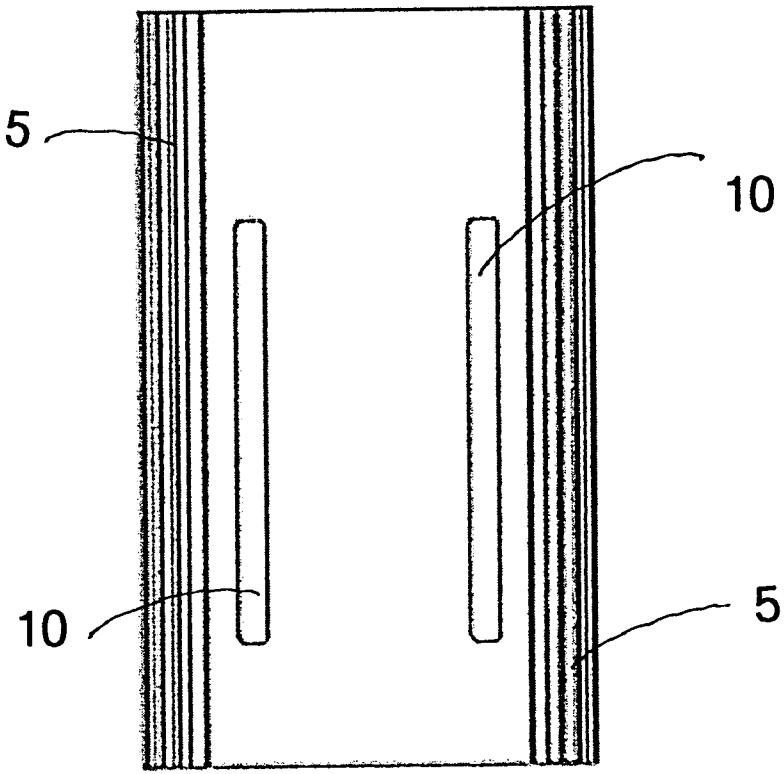
FIG. 2 is a perspective view of the protective enclosure as viewed from the back, showing the slotted openings for a belt or other strap

FIG. 2 is a perspective view of the protective enclosure as viewed from the back, showing the slotted openings 10, for a belt or other strap. This view also shows the protective enclosure ribs 5, in their full length. The enclosure ribs 5 wrap around the long sides of the enclosure and into the back of the enclosure, thus offering protection in back, in the event the enclosed device is laid down on its back by the user. The enclosure ribs 5 also afford protection for the enclosed device on the sides in the event of impacts with objects, as well as affording the user a sure and secure grip on the enclosed device.

Figure 3:
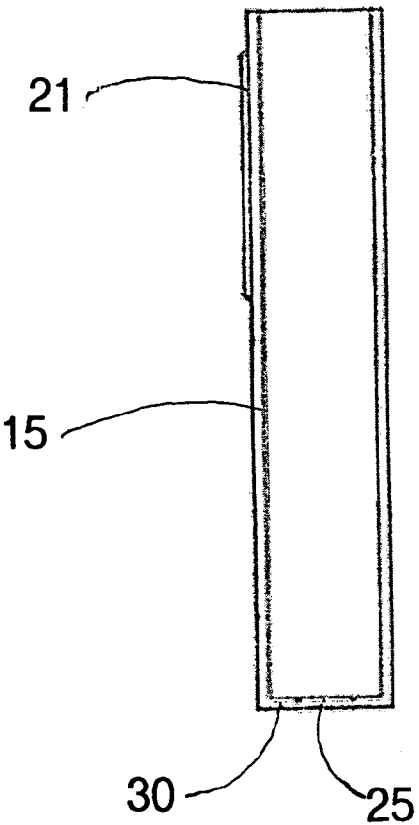
FIG. 3 is a perspective view of the protective enclosure as viewed from the side without the enclosure ribs

FIG. 3 is a perspective view of the protective enclosure as viewed from the side without the enclosure ribs 5. This view shows the relative positions for the enclosure base 30, the device visual display opening protruding frame 21, the device controls opening 15, and the device connections opening 25, all from a side view.

Figure 4:
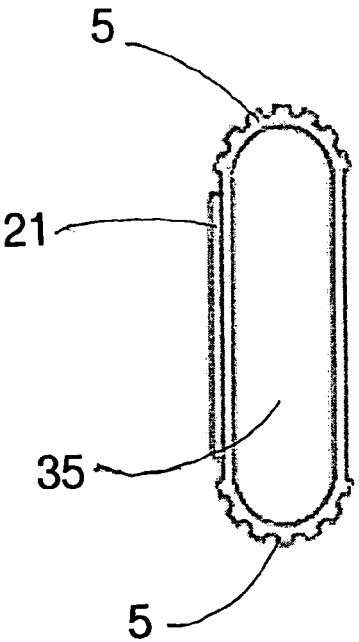
FIG. 4 is a perspective view of the protective enclosure as viewed from the top, showing the opening for inserting the device into the enclosure along with the top view of the enclosure ribs on the sides

FIG. 4 is a perspective view of the protective enclosure as viewed from the top, showing the device visual display opening protruding frame 21, showing the opening 35 for inserting the device into the enclosure along with the top view of the enclosure ribs 5 on the opposite sides of the enclosure.

Figure 5:
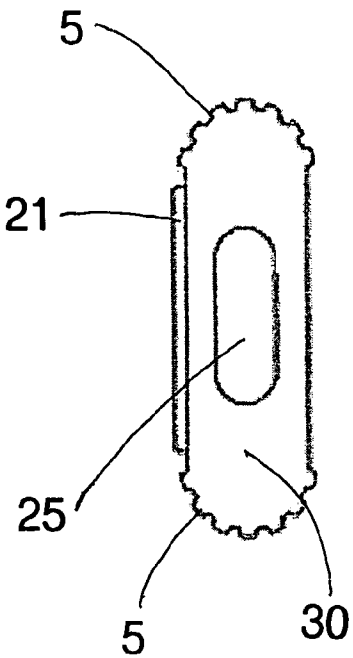
FIG. 5 is a perspective view of the protective enclosure as viewed from the bottom, showing the enclosure base with the device connections opening along with the bottom view of the enclosure ribs on the sides 2. Reference Numerals Numeral 5, enclosure ribs on both of the long sides of the rectangular enclosure, probably made of the same material as the rest of the enclosure and formed in the same process that creates the enclosure Numeral 10, slotted opening for a belt or other type of strap to hold the enclosure with the inserted device around a person's waist or other anchor Numeral 15, device controls opening to afford access by the user to the controls of the inserted device Numeral 20, device visual display opening to afford easy viewing of the status and program selection visual displays and other visual device communications with the user Numeral 21, device visual display opening protruding frame to afford extra protection for the status and program selection visual displays and other visual device communications with the user Numeral 25, device connections opening to afford access to the inserted device's external connections to power, program upload/download cables, etc.

FIG. 5 is a perspective view of the protective enclosure as viewed from the bottom, showing the device visual display opening protruding frame 21, showing the enclosure base 30, with the device connections opening 25 along with the bottom view of the enclosure ribs 5 on the opposing sides. The device connections opening 25, affords access to the inserted device's external connections to power, program upload/download cables, etc. (not shown).

It is to be understood that the present invention is not limited to the embodiments described above, but encompasses any and all embodiments within the scope of the following claims.

I claim:

1. A protective enclosure for a hand-held electronic device that both stores and plays digital audio recordings, comprising: a rectangular sheath-like container fashioned hollow with enclosing surfaces, from a shock-proof, flexible, elastic material in a shape substantially matching and hugging that of the electronic device it encloses on front, back, left side, right side and bottom surfaces, said protective enclosure provided with protruding parallel ribs positioned on the full length of both long sides of said protective enclosure and formed from the same material as said protective enclosure, and said protective enclosure providing a rectangular opening and a circular opening on the front surface, the rectangular opening in the front surface being used for access to the enclosed hand-held electronic device's visual display, and the circular opening in the front surface being used for access to the enclosed hand-held electronic device's controls, and said protective enclosure providing two parallel rectangular opening slots in the back surface, and providing a bottom surface with an elongated semi-circular hole being used for the enclosed hand-held electronic device's external connections to power, program upload/download cables, and other external connections.

2. The protective enclosure as in claim 1, wherein the top opening is of adequate dimension so as to allow insertion of said hand-held electronic device into said protective enclosure until the bottom of said inserted hand-held electronic device is flush against the bottom inside surface of said protective enclosure.

3. The protective enclosure as in claim 1, wherein the rectangular opening on the front surface being used for access to the enclosed hand-held electronic device's visual display provides a protruding rectangular frame formed from the same material as said protective enclosure.

4. The protective enclosure as in claim 1, wherein the two parallel rectangular opening slots in the back surface are of adequate dimension so as to allow for insertion of a belt or other type of strap inter-weaved through both parallel rectangular opening slots.

5. The protective enclosure as in claim 1, wherein said protruding parallel ribs are of adequate dimension to absorb shocks when said protective enclosure with said inserted hand-held electronic device impacts other objects or surfaces.

6. The protective enclosure as in claim 1, wherein said protruding parallel ribs are evenly spaced on both left and right long sides of said protective enclosure and continuing onto the front and back surfaces in a wrap-around configuration, so as to protect said inserted hand-held electronic device when the said protective enclosure is laid down on either its front or rear surface.

* * * * *